US006730869B2

(12) United States Patent
Teruyama et al.

(10) Patent No.: US 6,730,869 B2
(45) Date of Patent: May 4, 2004

(54) SWITCH

(75) Inventors: Shuji Teruyama, Fukuoka (JP); Hiroshi Hirahata, Fukuoka (JP); Nobutaka Imai, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/278,909

(22) Filed: Oct. 24, 2002

(65) Prior Publication Data

US 2003/0079979 A1 May 1, 2003

(30) Foreign Application Priority Data

Oct. 31, 2001 (JP) ..... P2001-335050

(51) Int. Cl.[7] ..... H01H 1/00
(52) U.S. Cl. ..... 200/516
(58) Field of Search ..... 200/5 R, 5 A, 200/406, 512–517

(56) References Cited

U.S. PATENT DOCUMENTS 3,806,673 A * 4/1974 Boulanger ..... 200/5 A
5,845,766 A * 12/1998 Sako et al. ..... 200/516
5,924,555 A * 7/1999 Sadamori et al. ..... 200/512
5,986,228 A * 11/1999 Okamoto et al. ..... 200/516
6,392,178 B1 * 5/2002 Kuratani ..... 20/512
2003/0000821 A1 * 1/2003 Takahashi et al. ..... 200/512

* cited by examiner

*Primary Examiner*—J. R. Scott
(74) *Attorney, Agent, or Firm*—Whitham, Curtis & Christofferson, P.C.

(57) ABSTRACT

A first conductive member and a second conductive member are disposed on a first face of a circuit board. A click spring is disposed on the first conductive member and deformed so as to establish an electrical contact between the first conductive member and the second conductive member, when a depressing force is applied thereto. An insulating film is disposed above the click spring. A spacer is interposed between the insulating film and the circuit board such that a first face thereof opposes to a first face of the insulating film and a second face thereof opposes to the first face of the circuit board. An adhesive layer is interposed between the first face of the circuit board and the second face of the spacer. The first adhesive layer has a viscosity such an extent that the spacer and the circuit board are detached from each other without damage.

18 Claims, 2 Drawing Sheets

SWITCH

BACKGROUND OF THE INVENTION

The present invention relates to a switch, and relates in particular to a switch wherein a click spring is located on the upper face of a fixed contact formed on a circuit board, and wherein the upper face of the circuit board is shielded by an insulating cover film.

A related-art switch of this type, i.e., a membrane switch, will now be described while referring to FIG. 4. Such a membrane switch 1 comprises: a circuit board 2; switch portions S, each of which includes a center fixed contact 3 and a circumferential fixed contact 4, both of which are arranged on the circuit board 2, and a hemispherical metal click spring 5 arranged over and on the fixed contacts 3 and 4; a spacer 6 formed on the circuit board 2; and an insulating cover film 7, which is bonded, using an adhesive M, to the upper faces of the click springs 5 and the spacer 6.

When the membrane switch 1 is incorporated in an electronic apparatus, such as a portable telephone or a keyboard, multiple switch portions S are sequentially arranged on the upper face of the circuit board 2, and the cover film 7 is bonded, using the adhesive M, to click springs 5 and the upper face of the spacer 6, which is mounted on the circuit board 2.

When one of the switch portions S is depressed directly or through pressure applied using a key top (not shown), the curved, raised portion of the click spring 5 is depressed and inverted, and the center of the lower face of the click spring 5 is brought into contact with the center fixed contact 3. The circumferential fixed contact 4 and the center fixed point 3 are thus rendered conductive by the click spring 5, and the switch portion S is turned on.

In this example, the adhesive M is also used to bond the spacer 6 to the circuit board 2. However, each switch portion S may be constituted by simply mounting a spacer 6 on the upper face of the circuit board 2 without using the adhesive M.

In the configuration wherein the adhesive is used to bond the spacer to the circuit board, when repair of the switch portions is required, the cover film to which the click springs and the spacer are bonded can not easily be removed from the circuit board because the spacer is securely attached thereto by the adhesive. Repairing the circuit board, therefore, is also impossible.

In the configuration wherein the spacer is merely mounted on the circuit board, repairs are possible; however, since no adhesive is used to seal a switch portion, foreign substances, such as dust or fluids, tend to enter a switch and to present an obstacle to electric contact, thereby contributing to a conductivity failure.

SUMMARY OF THE INVENTION

It is therefore an object of the present invention to provide a switch wherein the sealing of a switch portion can be accomplished by adhering a spacer to the upper face of a circuit board, and a cover film, to which a click spring and the spacer are bonded, can be easily removed from the circuit board to facilitate the repair of the switch portion.

In order to achieve the above object, according to the present invention, there is provided a switch, comprising:

a circuit board;

a first conductive member and a second conductive member, disposed on a first face of the circuit board;

a click spring, disposed on the first conductive member and deformed so as to establish an electrical contact between the first conductive member and the second conductive member, when a depressing force is applied thereto;

an insulating film, disposed above the click spring;

a spacer, interposed between the insulating film and the circuit board such that a first face thereof opposes to a first face of the insulating film and a second face thereof opposes to the first face of the circuit board; and a first adhesive layer, interposed between the first face of the circuit board and the second face of the spacer; the first adhesive layer having a viscosity such an extent that the spacer and the circuit board are detached from each other without damage.

In this configuration, the spacer can be easily removed from the circuit board. Therefore, not only the maintenance of the switch is extremely easy, but also the entry of foreign substances that can act as obstacles to the conduct of electricity can be prevented because the first adhesive layer serves to shield a switch portion (constituted by the conductive members and the click spring) of the switch from the outside, so that conductive failures will not occur.

Preferably, the first adhesive layer is comprised of at least one of acryl and silicon.

Preferably, the viscosity of the first adhesive layer is adjusted in accordance with a thickness thereof.

In this configuration, since the thickness can be arbitrarily adjusted in accordance with the materials employed for the circuit board and the spacer, the spacer can be stably adhered to the circuit board, and can be easily detached from the circuit board.

Preferably, the first adhesive layer is a screen-printed layer.

In this configuration, formation of the first adhesive layer can be performed accurately. And further, because this process can be automated, the amount of labor it requires can be reduced.

Preferably, the switch further comprises a second adhesive layer, provided on a second face of the insulating film, on which an external member is mounted, the second adhesive layer having a viscosity such an extent that the external member and the insulating cover are detached from each other without damage.

In this configuration, the second adhesive layer can be used to attach electronic parts, such as key tops, to the insulating film. Subsequently, adhering the electronic parts to or removing them from the cover film can be performed quickly and easily. Therefore, if a key top, for example, is broken, it can be easily exchanged as part of the normal maintenance for the keyboard.

Here, it is preferable that the second adhesive layer is comprised of at least one of acryl and silicon.

Further, it is preferable that the viscosity of the second adhesive layer is adjusted in accordance with a thickness thereof.

Still further, it is preferable that the second adhesive layer is a screen-printed layer.

According to the present invention, there is also provided a switch, comprising:

a circuit board;

a first conductive member and a second conductive member, disposed on a first face of the circuit board;

a click spring, disposed on the first conductive member and deformed so as to establish an electrical contact between the first conductive member and the second conductive member, when a depressing force is applied thereto;

an insulating film, disposed above the click spring;

a first adhesive layer, provided on a first face of the insulating film, on which an external member is mounted, the first adhesive layer having a viscosity such an extent that the external member and the insulating cover are detached from each other without damage.

Preferably, the first adhesive layer is comprised of at least one of acryl and silicon.

Preferably, the viscosity of the first adhesive layer is adjusted in accordance with a thickness thereof.

Preferably, the first adhesive layer is a screen-printed layer.

Preferably, the switch further comprises:

a spacer, interposed between the insulating film and the circuit board such that a first face thereof opposes to a second face of the insulating film and a second face thereof opposes to the first face of the circuit board; and a second adhesive layer, interposed between the first face of the circuit board and the second face of the spacer, the second adhesive layer having a viscosity such an extent that the spacer and the circuit board are detached from each other without damage.

Here, it is preferable that the second adhesive layer is comprised of at least one of acryl and silicon.

Further, it is preferable that the viscosity of the second adhesive layer is adjusted in accordance with a thickness thereof.

Still further, it is preferable that the second adhesive layer is a screen-printed layer.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
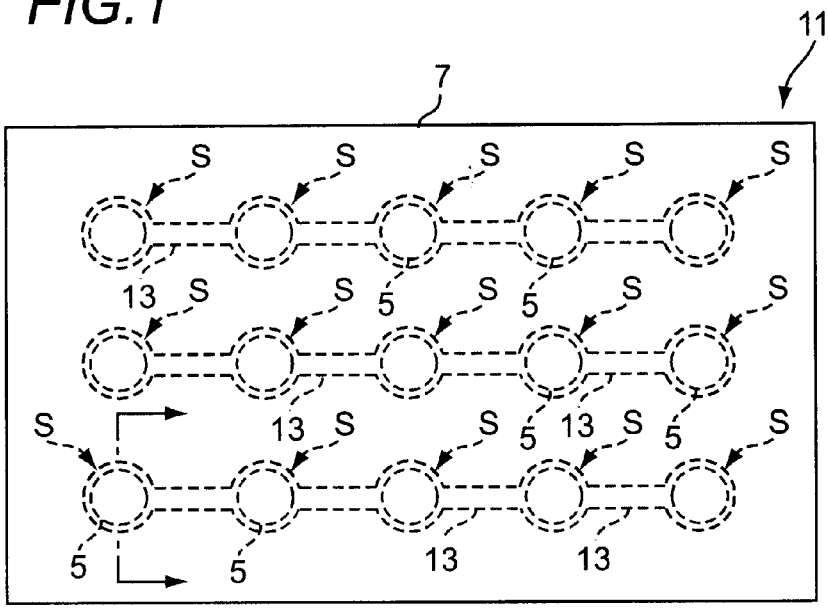
FIG. 1 is a plan view of a membrane switch according to a first embodiment of the present invention.

Preferred embodiments of the present invention will now be described while referring to the accompanying drawings. For this explanation, the same reference numerals as are used for the relate-art examples are employed to denote corresponding components.

Figure 2:
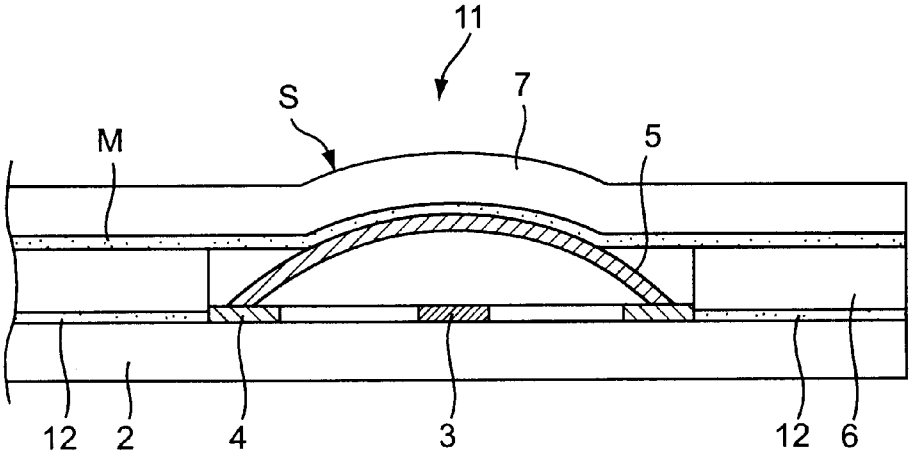
FIG. 2 is an enlarged cross sectional view taken along the line A—A in FIG. 1.

A membrane switch 11 according to a first embodiment is shown in FIGS. 1 and 2. The membrane switch 11 comprises: a switch portion S, which includes a circuit board 2 formed of a flexible film, a center fixed contact 3 and a circumferential fixed contact 4 that are arranged on the circuit board 2 and a hemispherical metal click spring 5 provided above and on the fixed contacts 3 and 4; a spacer 6 formed on the circuit board 2; and an insulating cover film 7 that, using an adhesive M, is bonded to the upper faces of the click spring 5 and the spacer 6 to position them. The membrane switch 11 is employed for a portable telephone and the keyboard of a personal computer.

The spacer 6 is provided by forming a predetermined space to each switch portion S and by smoothly performing the switching operation using the click spring 5. Further, a less viscous agent layer 12, made of acrylic resin or silicon, is formed by screen printing at the positions on the lower face of the spacer 6, except for the positions of the switch portions S.

Therefore, the less viscous agent layer 12 can be easily formed on the lower face of the spacer 6, and the spacer 6 and the circuit board 22 can be detached from each other without damage. Acrylic resin or silicon is employed for the less viscous agent layer 12; however, the materials that can be used are not limited to these. Further, the viscosity of the less viscous agent layer 12, relative to the spacer 6 and the circuit board 2, or some other part, is adjusted by varying the thickness of the layer 12. Therefore, since the thickness of the layer 12 need only be adjusted to respond to changes in the materials used for the circuit board 2 and the spacer 6, the spacer 6 can be easily detached from the circuit board 2 without damage.

When the key top (not shown) of one of the switch portions S is depressed, the curved, raised face of the click spring 5 is pushed down and inverted and the center of the lower face of the click spring 5 is brought into contact with the center fixed contact 3. Thus, the circumferential fixed contact 4 and the center, fixed contact 4 are rendered conductive, and the switch portion S is turned on. Then, when the key top is released, it is returned to its initial state by the force exerted by the click spring 5 as it assumes its original shape, and the switch portion S is turned off.

When after extensive, repetitive use of the membrane switch 11, for some specific reason the functioning of one or more of the switch portions S is impaired, the spacer 6, the cover film 7 and the click springs 5 must be removed from the circuit board 2 in order for repairs to be made. At this time, since the less viscous agent layer 12 is used to bond the spacer 6 to the circuit board 2, removing the click springs 5 and the cover film 7 from the circuit board 2 is not difficult. Therefore, when repairs are required, they can be made extremely easily.

As is described above, when the less viscous agent layer 12 is used to bond the cover film 7 to the circuit board 2, the switch portions S are also sealed, thereby preventing the occurrence of a conductive failure resulting from the entry into a switch portion S of a foreign substance that acts as an obstacle to the conduct of electricity.

Figure 3:
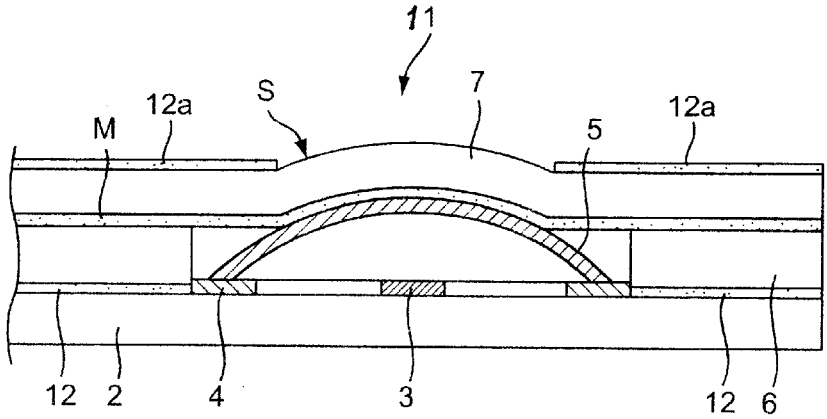
FIG. 3 is an enlarged, vertical, cross-sectional side view of a switch portion according to a second embodiment of the present invention.
Figure 4:
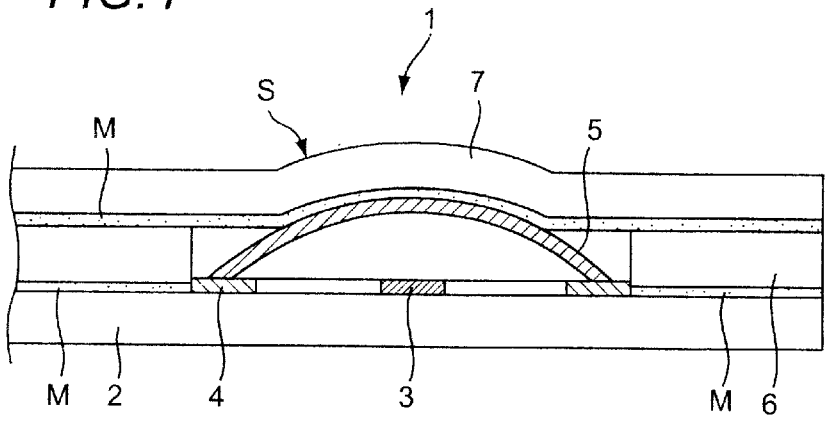
FIG. 4 is an enlarged, vertical, cross-sectional side view of a switch portion of a related-art membrane switch.

FIG. 3 is a side cross-sectional view of a membrane switch 11 according to a second embodiment. In this embodiment, screen printing is used to form a less viscous agent layer 12*a* composed of acrylic resin or silicon on the cover film 7 except for locations directly above the switch portions S. The less viscous agent layer 12*a* is provided as the upper cover for the cover film 7 so that an electronic part, such as a key top (not shown), can be easily adhered to or removed from the cover film 7. Therefore, when an electronic part such as a key top is thus secured to the cover film 7, its exchange and maintenance can be easily performed. In this case, although the less viscous agent layer 12 is used to bond the spacer 6 and the circuit board 6, any means may be adopted.

An air channel 13 is formed in the membrane switch 11 as shown in FIG. 1, and along the air channel 13, defined in the switch portions S, are communicating spaces P that are provided to facilitate the distribution of air and to thus enable the smooth operation of the switching performed by the switch portions S. The present invention is not limited to the use of this channel.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

For example, instead of the spacer 6, screen printing may be used to form an adhesive layer having a predetermined thickness on the lower face of the cover film 7.

What is claimed is:

1. A switch, comprising:

a circuit board;

a first conductive member and a second conductive member, disposed on a first face of the circuit board;

a click spring, disposed on the first conductive member and deformed, the first conductive member electrically contacting the second conductive member when a depressing force is applied to the click spring;

an insulating film, disposed above the click spring;

a spacer, interposed between the insulating film and the circuit board such that a first face of the spacer opposes a first face of the insulating film and a second face of the spacer opposes the first face of the circuit board; and a first adhesive layer, interposed between the first face of the circuit board and the second face of the spacer, the first adhesive layer having viscosity that the spacer and the circuit board detach from each other without damage, with one face of the first adhesive layer contacting the second face of the spacer and the other face of the first adhesive layer contacting the first face of circuit board.

2. The switch as set forth in claim 1, wherein the first adhesive layer is comprised of at least one of acryl and silicon.

3. The switch as set forth in claim 1, wherein the viscosity of the first adhesive layer is adjusted in accordance with a thickness thereof.

4. The switch as set forth in claim 1, wherein the first adhesive layer is a screen-printed layer.

5. The switch as set forth in claim 1, further comprising a second adhesive layer, provided on a second face of the insulating film, on which an external member is mounted, the second adhesive layer having viscosity that the external member and the insulating cover detach from each other without damage.

6. The switch as set forth in claim 5, wherein the second adhesive layer is comprised of at least one of acryl and silicon.

7. The switch as set forth in claim 5, wherein the viscosity of the second adhesive layer is adjusted in accordance with a thickness thereof.

8. The switch as set forth in claim 5, wherein the second adhesive layer is a screen printed layer.

9. A switch, comprising:

a circuit board;

a first conductive member and a second conductive member, disposed on a first face of the circuit board;

a click spring, disposed on the first conductive member and deformed, the first conductive member electrically contacting the second conductive member when a depressing force is applied to the click spring;

an insulating film, disposed above the click spring;

a first adhesive layer, provided on a first face of the insulating film, the first adhesive layer having viscosity that the insulating film may receive a detachable external member that detaches without damage.

10. The switch as set forth in claim 9, wherein the first adhesive layer is comprised of at least one of acryl and silicon.

11. The switch as set forth in claim 9, wherein the viscosity of the first adhesive layer is adjusted in accordance with a thickness thereof.

12. The switch as set forth in claim 9, wherein the first adhesive layer is a screen-printed layer.

13. The switch as set forth in claim 9, further comprising:

a spacer, interposed between the insulating film and the circuit board such that a first face of the spacer opposes a second face of the insulating film and a second face of the spacer opposes the first face of the circuit board; and a second adhesive layer, interposed between the first face of the circuit board and the second face of the spacer, the second adhesive layer having viscosity that the spacer and the circuit board detach from each other without damage.

14. The switch as set forth in claim 13, wherein the second adhesive layer is comprised of at least one of acryl and silicon.

15. The switch as set forth in claim 13, wherein the viscosity of the second adhesive layer is adjusted in accordance with a thickness thereof.

16. The switch as set forth in claim 13, wherein the second adhesive layer is a screen-printed layer.

17. A switch, comprising:

a circuit board;

a first conductive member and a second conductive member, disposed on a first face of the circuit board;

a click spring, disposed on the first conductive member and deformed, the first conductive member electrically contacting the second conductive member when a depressing force is applied to the click spring;

an insulating film, disposed above the click spring;

a spacer, interposed between the insulating film and the circuit board such that a first face of the spacer opposes a first face of the insulating film and a second face of the spacer opposes the first face of the circuit board; and a first adhesive layer, interposed between the first face of the circuit board and the second face of the spacer, the first adhesive layer being comprised of at least one of acryl and silicon.

18. The switch of claim 9, wherein the receivable, detachable external member is a key top.

* * * * *